United States Patent [19]

McKeown

[11] Patent Number: 4,796,767

[45] Date of Patent: Jan. 10, 1989

[54] PRESSURE APPLICATOR

[76] Inventor: Frank R. McKeown, 1044 Kennedy Road, Scarborough, Ontario, Canada, M1P 2K6

[21] Appl. No.: 93,723

[22] Filed: Sep. 8, 1987

[30] Foreign Application Priority Data

Jul. 8, 1987 [CA] Canada ..... 541604

[51] Int. Cl.[4] ..... A61J 9/00

[52] U.S. Cl. ..... 215/11.1; 215/11.3; 215/100 R; 222/386

[58] Field of Search ..... 215/11.1, 11.3, 100 R, 215/101; 222/95, 326, 386, 389; 29/110.5; 81/488

[56] References Cited

U.S. PATENT DOCUMENTS

| | | | |
|---|---|---|---|
| 2,469,489 | 5/1949 | Allen et al. | 215/11.1 |
| 2,625,131 | 1/1953 | Sturhahn | 215/101 |
| 2,793,778 | 5/1957 | Maxwell | 215/11.1 |
| 2,801,541 | 8/1957 | Moreland | 215/101 |
| 2,920,779 | 1/1960 | Armitage | 215/100 R |
| 3,249,250 | 5/1966 | McKee | 215/100 R |
| 3,595,449 | 7/1971 | Stump | 222/386 |
| 3,648,873 | 3/1972 | Grobbel | 215/11.3 |
| 3,768,684 | 10/1973 | Buchtel | 215/100 R |
| 3,822,806 | 7/1974 | Grimes | 215/11.3 |
| 3,880,281 | 4/1975 | Taddei | 215/101 |
| 3,955,698 | 5/1976 | Hammer | 215/11.3 |
| 4,176,754 | 12/1979 | Miller | 215/11.3 |
| 4,234,316 | 11/1980 | Hevey | 422/58 |
| 4,579,236 | 4/1986 | Zimmermann | 215/100 R |

FOREIGN PATENT DOCUMENTS

| | | | |
|---|---|---|---|
| 740189 | 11/1955 | United Kingdom | 215/11.1 |

*Primary Examiner*—David T. Fidei
*Attorney, Agent, or Firm*—Michael M. Sakovich

[57] ABSTRACT

A pressure applicator useful in expelling air from a flexible liner enclosed within a thin-walled shell of a nursing bottle comprises a pushrod having a clip at one end for attachment to an edge of the shell. The opposite end of the pushrod includes an orthogonally positioned pad that is insertable into the shell from one open end to compress the liner, thereby expelling air through a nipple positioned at an opposite end in communication with the liner. One embodiment of the applicator is a unitary structure whereas other embodiments disclose separate pads which are attachable to either an end of a pushrod for air expulsion or to a side member of the pushrod for storage. Another embodiment includes a pair of protuberances on the pushrod that frictionally engage corresponding slots in the shell for attachment thereto.

19 Claims, 6 Drawing Sheets

PRESSURE APPLICATOR

FIELD OF THE INVENTION

This invention relates to nursing bottles of the type comprising a shell having a flexible liner that functions as a container and, more particularly, to apparatus for expelling air from the liner to prevent the ingestion of air

BACKGROUND OF THE INVENTION

In a conventional nursing bottle having rigid side walls, both formula and air are present such that both are by a feeding infant which feels discomfort and distress due to the presence of air in the infant's stomach. The development of nursing bottles comprising thin-walled shells that enclose a flexible liner that functions as a container per se was intended to alleviate if not eliminate the problem of air ingestion.

It was believed that as formula was drawn from the flexible liner, the side walls of the liner would collapse about the remaining formula, thereby avoiding the creation of a partial vacuum within the bottle as occurs in those bottles having rigid sides. It has been determined, however, that air will still be drawn into a nursing bottle having a flexible liner, especially after the contents are partially drawn out and the bottle is turned upright. Although the side walls of the liner do collapse, the tension exerted on the side walls by the weight of the formula at the bottom of the liner tends to separate the collapsed side walls which generates a partial vacuum within the liner that draws in air.

As a result of the continuing problem, various forms of pushsticks have been developed to expel air from nursing bottles having flexible liners.

A typical example of apparatus for expelling air from a nursing bottle is illustrated and described in U.S. Pat. No. 3,648,873 Grobbel. The apparatus includes a base upon which a dowel is vertically mounted, the uppermost end of the dowel having attached thereto a short cylindrical member that is slidably reciprocable within the bottle shell to collapse the liner for expelling air therefrom.

Another example of similar apparatus is described in U.S. Pat. No. 4,176,754 Miller. Instead of a fixed combination of a short cylinder attached to the end of a dowel, Miller describes and illustrates a soft wheel that is rotatably mounted at one end of a handle. The diameter of the wheel is somewhat greater than the inner diameter of the bottle's shell so that when the wheel is inserted into the shell through an open end, the wheel is compressed and a inner is expelled by compressing the liner by means of the wheel. However, the restoring force set up within the wheel maintains the wheel in any given position within the bottle to ensure that air is not subsequently drawn back into the liner.

Both Grobbel and Miller describe structures that, while eminently suited to the task of expelling air from the flexible liner, are large and relatively bulky such that these structures do not appear to be cost effective. Moreover, the relatively large size of both structures presents a storage problem which is further aggravated if more than one is used in a household.

SUMMARY OF THE INVENTION

A principal objective of the present invention is to provide a cost effective apparatus for expelling air from a flaccid container.

Another provision of the invention is such apparatus that is conveniently storable within a shell of a nursing bottle having a flexible liner.

Still another provision of the invention is apparatus for expelling air from a nursing bottle having a flexible liner The problems associated with the prior art may be substantially overcome and the foregoing objectives achieved , by recourse to my invention which is an apparatus for expelling air from a flaccid container carried within a nursing bottle having open ends and a nipple disposed at one end in communication with an outlet of the container. The apparatus comprises a pushrod member with elongated narrow sides adapted to lie along a side wall of the bottle in removably storable relation therewith, attachment means disposed on one side of the member for fastening same to one of, the side wall of the bottle and a support hanger, and pad means disposed at one end of the pushrod member for engaging an external surface of the container to apply a force thereagainst, whereby the container is collapsed to expel air contained therein.

BRIEF DESCRIPTION OF THE DRAWINGS

The invention will now be more particularly described with reference to embodiments thereof shown, by way of example, in the accompanying drawings wherein.

DESCRIPTION OF THE ILLUSTRATED EMBODIMENTS

Having regard to the illustrated embodiments of the invention and the descriptions thereof which follow, it , will be observed that certain structural features are common. In order that continuity of structure may be readily recognized in the various embodiments, like numerals are used to designate like structural features; all made from suitable plastic.

Figure 1:
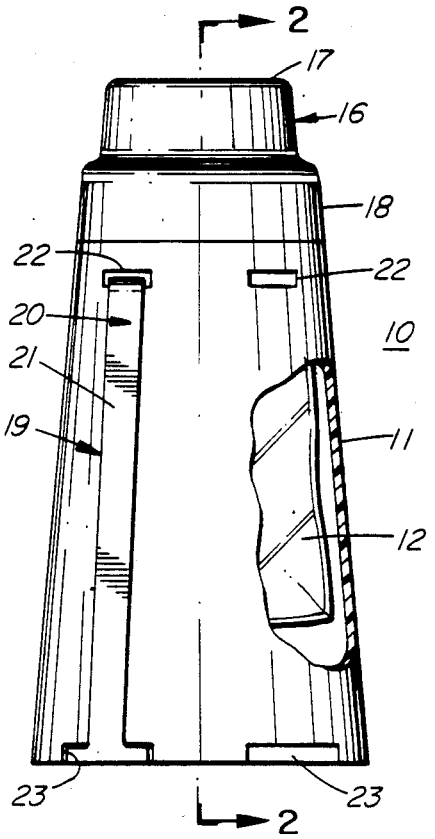
FIG. 1 is aside elevational view of a nursing bottle with a flaccid container illustrating one embodiment of the present invention.
Figure 2:
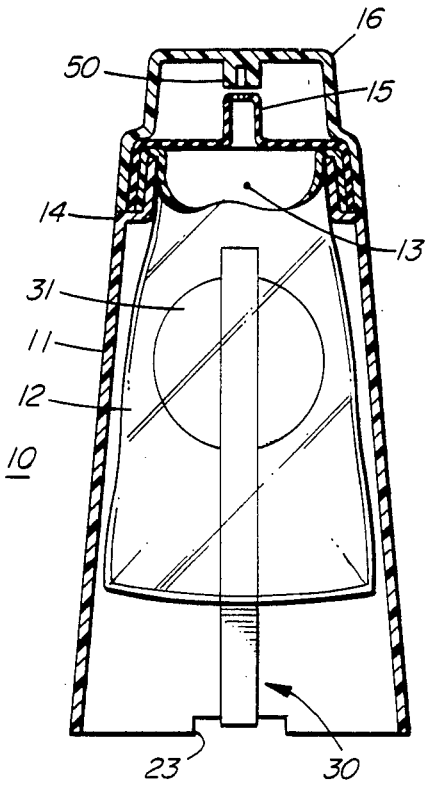
FIG. 2 is a cross-sectional view of FIG. 1 taken along the lines 2—2 and illustrates a second embodiment of the invention.

FIG. 1 illustrates a side elevational view of a nursing bottle 10 having a thin-walled shell 11 that encloses a flexible liner shown as a flaccid container 12. Both ends of the shell 11 are open with the bottom end providing access to the container 12 so that air may be expelled therefrom. The upper end, as best seen in FIG. 2, provides known means for securing an open end 13 of the container 12 to a rim 14 of the shell 11. Additionally, known means are illustrated for attaching a nipple 15 to the rim 14 in order that the nipple and the container 12 may be in communication. The bottle 10 structure is completed by a cap 16 having a closed end 17 and , side walls 18 which are adapted to frictionally engage the rim 14 to form a nipple enclosure.

One embodiment of an apparatus for expelling air from the container 12 is shown in FIG. 1 as a unitary pressure applicator 19 that comprises a pushrod 20 formed from an elongated narrow strip 21 which is adapted to lie along the shell 11 in removably storable relation.

Figure 3:
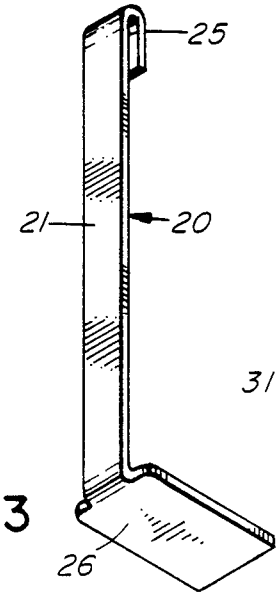
FIG. 3 is a perspective view of apparatus for expelling air from the flaccid container of FIG. 1.

One storage feature is provided through the combination of slots 22, formed at the upper end of the shell 11, notches 23, formed in the bottom edge of the shell 11, and attachment means that form a part of the pushrod 20 in the embodiment of FIG. 1. Such attachment means comprise a clip 25 formed by a portion of the strip 21 adjacent a free end of the strip. As indicated, the portion of the strip 21 forming the clip 25 is folded over and overlies the strip 21 in spaced relation as best seen in FIG. 3. It will be understood from FIG. 1 that 20 depends therefrom.

A pad 26 portion of the pushrod 20 is widened for engaging an external surface of the container 12 to apply a , air to be expelled therefrom. It will be observed in FIG. 3 that the pad 26 is bent orthogonally to the long axis of the , pushrod 20 in the region where the pad 26 and the strip 21 are integrally joined.

The width of the notches 23 is sufficient to accommodate the full width of the pad 26, thus permitting the pad 26 to be contained within the shell 11. The spacing between corresponding slots and notches is such that the applicator 19 is held firmly against the shell 11, the respective bent portions of the clip 25 and the pad 26 providing a locking fit.

Removal of the applicator 19 is performed simply by withdrawing the pad 26 through its notch 23 followed by raising : the applicator 19 so that the hook formed by the clip 25 is raised clear of the slot 22. The pushrod 20 is then used as a handle, forcing the pad 26 against the container 12 to collapse same and expel air contained therein.

An advantage of mounting the applicator 19 in this way permits utilizing the strip 21 as means to carry indicia (not shown) thereon for bottle identification. This is a particularly useful feature where a number of otherwise identical bottles are temporarily stored as, for example, in a refrigerator during a social gathering. Appropriate indicia on the strips 21 will readily identify individual bottles.

Figure 4:
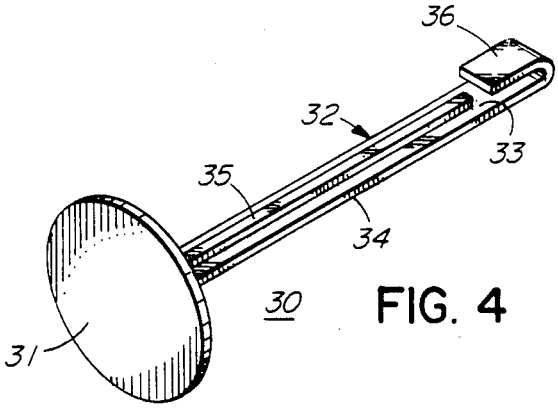
FIG. 4 is a perspective view of another apparatus for expelling air from the flaccid container of FIG. 1.

Another embodiment of apparatus for expelling air from the container 12 is shown in FIG. 4 as a pressure applicator 30 that comprises two separably connectable components. One of these components is a circular pad 31 that is attached by means of a frictional socket arrangement to a pushrod 32. It will be observed in this embodiment that the pushrod 32 has a "T" cross-section that is formed by a first flat strip scribed, and a second flat strip 35 that is centrally positioned on the obverse side of the strip 33 in mutually orthogonal relation.

A clip 36 is formed by a portion of the strip 33 adjacent one end as shown and is folded over and overlies the strip 33 in spaced relation. This permits the clip 36 to engage an edge of the shell 11 in one of the notches 23 thereby permitting the pushrod 32 to lie along an inner surface of the shell 11 as illustrated in FIG. 2. Although FIG. 2 is a cross-sectional view of FIG. 1, both figures showing respective applicators 19 and 30, it will be understood that only one such applicator would be used and that this drawing expedient is used solely in the interest of brevity.

Figure 5:
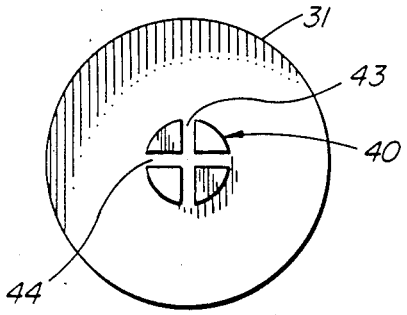
FIG. 5 is a plan view of a pad shown in FIG. 4.
Figure 6:
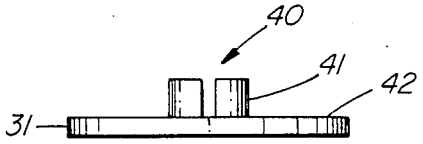
FIG. 6 is a side elevational view of the pad shown in FIG. 5.
Figure 7:
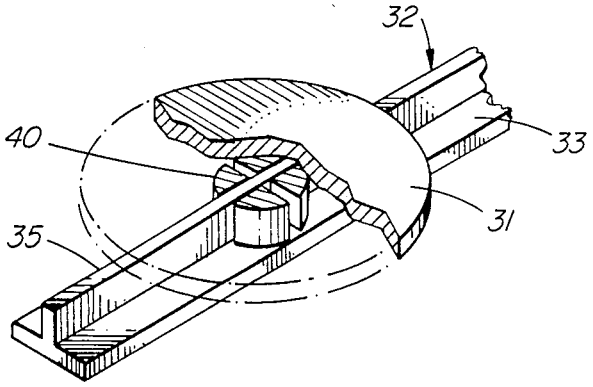
FIG. 7 is a perspective view of the pad of FIG. 5 shown in a stored position on a pushrod.

Various views of the individual components of the applicator 30 are shown in FIGS. 5, 6 and 7. Thus, a plan view in FIG. 5 of the pad 31 and a corresponding side elevation view of the pad in FIG. 6 reveals a socket member 40 that comprises a truncated stem 41 that is outstanding from a trailing surface 42 of the pad 31. Mutually orthogonal crossed slots 43 and 44 are formed in the stem 41 over its full length as shown and are adapted to frictionally engage the "T" cross section of the pushrod 32 which is most clearly seen in FIG. 7.

Having regard to FIG. 7, together with FIG. 5, it will be observed that one of the slots 43, 44 of the stem 41 frictionally engages the strip 35 where the pad 31 is securely held in place for storage. A typical storage position within the bottle 10 appears in FIG. 2.

Figure 10:
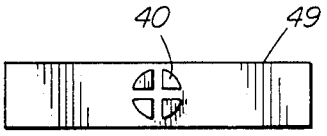
FIGS. 8, 9 and 10 are respective plan views showing various geometric shapes for a pad in accordance with the invention.
Figure 8:
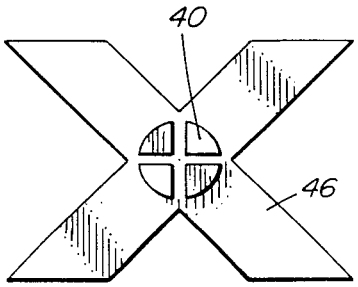
Figure 9:
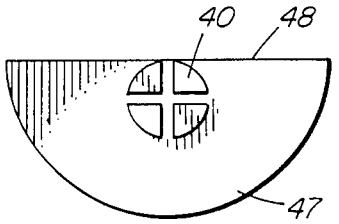

In keeping with the objectives of the invention, it will be understood that the pads 26 and 31 may take other geometric forms, three examples of which appear in FIGS. 8, 9 and 10. Thus, FIG. 8 shows a pad 46 in the form of a complex polygonal figure in an "X" conformation. FIG. 9 illustrates a pad 47 in the form of a semi-circle having a rectilinear chord edge 48. In FIG. 10, a pad 49 is generally rectangular in shape. Connection to a pushrod such as the pushrod 32 is made via the member 40 in each instance.

Having regard to the cross-sectional view of the cap 16 in FIG. 2, it will be understood that the cap may also be used as a pad by configuring the cap 16 to include a centrally positioned socket member 50 adapted to engage the "T" cross section end of the pushrod 32.

In each embodiment of the various pads to which reference has been made, it will be understood that the pads are slidably reciprocable within the shell 11. In this respect, it will be observed that the shell 11 is convergingly tapered towards the cap 16 in order to provide a wider bottom access opening to permit slidably reciprocal movement of the cap 16 within the shell 11. A cylindrical shell 11 would be less desirable in view of the similarity of corresponding diameters which require observing close tolerances to permit a freely slidable fit of the cap 16 within the shell 11.

Figure 11:
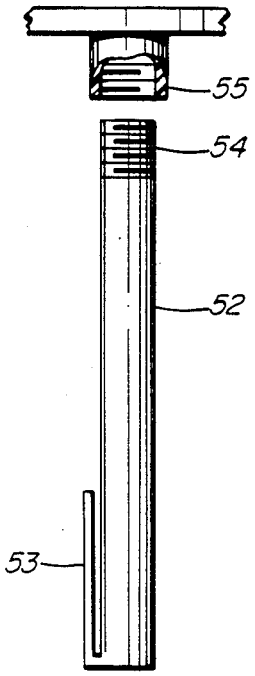
FIG. 11 is a side elevational view of another pushrod embodiment.

Whereas the pushrod 20 and 32 have been described as being fabricated from strip material, FIG. 11 illustrates a pushrod 52 that is cylindrical in form and may either be solid or tubular. One end of the pushrod is shown to include a clip 53 which is similar functionally and structurally to the clips previously described herein.

The other end of the pushrod 52 has a threaded portion, 54 for threadedly engaging corresponding threads on a socket member 55 which could be employed as a substitute for the socket member 40.

Figure 12:
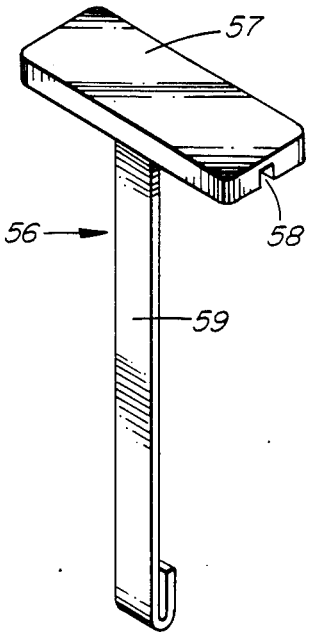
FIG. 12 is a perspective view of yet another apparatus for expelling air from the flaccid container of FIG. 1.

FIG. 12 illustrates yet another embodiment of a pressure applicator 56 having a removable pad 57 that includes a fabricated from a single strip. Similar to the applicator 30 embodiment, the pad 57 may be stored on the pushrod 59 by engaging a side edge of the pushrod instead of the end thereof as illustrated for a pushing configuration.

Figure 13:
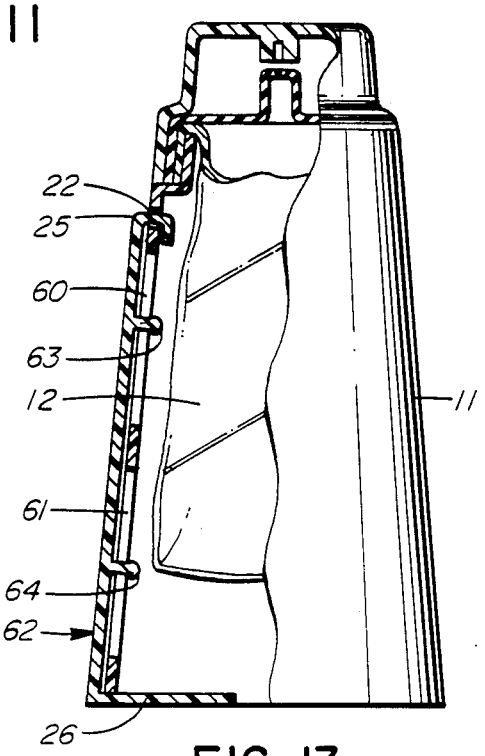
FIG. 13 is a sectional view of still another pushrod embodiment.

Any one of the aforedescribed pushrods may be attached more securely to the shell 11 by the addition of a simple expedient illustrated in section in FIG. 13. The shell 11 includes two vertical slots 60 and 61 which are usually provided to view the level of formula in the container 12. As an illustrative example, a pushrod 62, similar to the pushrod 20, will be seen to include two protuberances 63 and 64 that are adapted to frictionally engage corresponding slots 60 and 61, thereby providing a more secure attachment than the clip 25 engaging the slot 22 alone. If desired, the clip 25 and slot 22 may be omitted and the protuberances 63, 64 and slots 60, 61 substituted as alternative attachment means. Pushrods 32, 52 and 59 may be likewise modified to either change or improve attachment to the shell 11.

It will be apparent to those skilled in the art that the aforedescribed embodiments may be varied to meet particular specialized requirements without departing from the true spirit and scope of the invention disclosed. For example, whereas the various pushrods have been illustrated to show a straight structure, a pushrod may have an irregular structure with jogs to assist in storing a pad. These embodiments are therefore not to be taken as indicative of the limits of the . invention but rather as exemplary structures thereof which is defined by the claims appended hereto.

The embodiments of the invention is which an exclusive property of privilege is claimed are defined as follows:

1. Apparatus for expelling air from a flaccid container carried within a nursing bottle having open ends and a nipple disposed at one end in communication with an outlet of the container, comprising in combination:

a pushrod member with elongated narrow sides adapted to lie unobtrusively along a side wall of the bottle in removably storable relation therewith;

attachment means disposed cooperatively between the bottle and member for detachably fastening the latter at a plurality of positions thereon to the side wall of the bottle; and pad means disposed substantially orthogonally at one end of the pushrod member interiorly of the free end of the bottle for supportively engaging an external surface of the container by applying a restraining force thereagainst, whereby the container is collapsed to expel air contained therein when the restraining force is exceeded.

2. Apparatus as in claim 1 wherein the pad means comprises a slidable pad reciprocably movable within the nursing bottle and further comprising:

a leading surface engageable with the container to apply said force thereagainst;

a trailing surface; and connection means disposed on the trailing surface for attaching the pad to the pushrod member.

3. Apparatus as claimed in claim 2 wherein the pushrod member comprises a first flat strip adapted to carry indicia thereon for bottle identification and the attachment means comprises a clip formed by a portion of the strip adjacent a free end thereof folded over and overlying the strip in spaced relation.

4. Apparatus as claimed in claim 3 wherein the attachment means further comprises a vertical slot in the side wall of the bottle together with at least one protuberance on the pushrod member adapted to frictionally engage the vertical slot for attachment thereto.

5. Apparatus as claimed in claim 4 wherein the pad means comprises a widened portion of the pushrod member bent orthogonally to the long axis thereof in the region of said connection means.

6. Apparatus as claimed in claim 2 wherein the connection means comprises one of, a threaded member adapted to threadedly engage corresponding threads formed at one end of the pushrod member, and a socket member adapted to frictionally engage one end of the pushrod member.

7. Apparatus as claimed in claim 4 wherein the pushrod member further comprises a second flat strip positioned in mutually orthogonal relation to the first flat strip to form a "T" cross-section therewith.

8. Apparatus as claimed in claim 6 wherein the pushrod member comprises a cylindrical rod having one end adapted to theadedly engage the threaded member

9. Apparatus as claimed in claim 8 wherein the attachment means comprises a clip integrally formed with the free end of the cylindrical rod and comprising a narrow rectilinear member overlying a portion of the rod in spaced relation.

10. Apparatus as claimed in claim 6 wherein the leading surface of the pad comprises a flat polygonal figure, including a square, a rectangle and a triangle.

11. Apparatus as claimed in claim 10 wherein the leading surface of the pad comprises a flat geometrical figure selected from one of, a circle and a semi-circle having a rectilinear chord edge.

12. Apparatus as claimed in claim 11 wherein the connection means is centrally disposed on the trailing surface of the pad and comprises a socket member adapted to frictionally engage selectively one end of the pushrod member and a side wall portion thereof.

13. Apparatus as claimed in claim 12 wherein the socket member comprises:

a truncated stem outstanding from the trailing surface; and a pair of mutually orthogonal crossed slots formed in the stem.

14. Apparatus as claimed in claim 13 wherein the pushrod member comprises: ;

a first flat strip adapted to carry indicia thereon for bottle identification;

a second flat strip positioned in mutually orthogonal relation to the first flat strip to form a "T" cross-section therewith which, at one end of the flat strips, is frictionally engageable with both crossed slots and, along any free edge of the flat strips, is engageable with one of the slots; and wherein the attachment means comprises a clip formed by a portion of the first strip adjacent a free end thereof folded over and overlying the first strip in spaced relation.

15. Apparatus as claimed in claim 4 wherein the connection means is centrally disposed on the trailing surface of the pad and comprises a socket member having a slot for frictionally engaging selectively one end of the first flat strip and either free edge thereof.

16. Apparatus as claimed in claim 2 wherein the pushrod member comprises a first flat strip adapted to carry indicia thereon for bottle identification and the attachment means comprises a vertical slot in the side wall of the bottle together with at least one protuberance on the pushrod member thereto.

17. Apparatus as claimed in claim 13 wherein the member comprises:

a first flat strip adapted to carry indicia thereon , for bottle identification;

a second flat strip positioned in mutually orthogonal relation to the first flat strip to form a "T" cross-section therewith which, at one end of the flat strips, is frictionally engageable with both crossed slots and, along any free edge of , the flat strips, is engageable with one of the slots; and wherein the attachment means comprises a vertical : slot in the side wall of the bottle together with at least one protuberence on the pushrod member adapted to frictionally engage the vertical slot for attachment thereto.

18. Apparatus as claimed in claim 4 further comprising a slot in the side wall of the bottle, the slot being formed to receive the clip in removably storable relation therewith.

19. Apparatus for expelling air from a flaccid container carried within a nursing bottle having open ends and a nipple disposed at one end in communication with an outlet of the container, comprising:

a pushrod member with elongated narrow sides adapted to lie along a side wall of the bottle in removably storable relation therewith;

attachment means disposed on one side of the member for fastening same with one of, the side wall of the bottle and a support hanger, and a nursing bottle cap reciprocably slidable within the bottle and comprising a closed end having a leading surface engageable with an external surface of the container to apply a force thereagainst for collapsing the container to expel air contained therein, a trailing surface, connection means disposed on the trailing surface for detachably attaching the cap to one end of the pushrod member, and side walls adapted to frictionally engage the rim of the open end of the bottle at which the nipple is disposed to form a nipple enclosure thereat.

* * * * *